US007669299B2

(12) United States Patent
McAnelly

(10) Patent No.: US 7,669,299 B2
(45) Date of Patent: Mar. 2, 2010

(54) GUITAR STRAP CONNECTOR

(76) Inventor: Donald Eugene McAnelly, 97 Timberline Ct. South, Elizabethtown, KY (US) 42701

( * ) Notice: Subject to any disclaimer, the term of this patent is extended or adjusted under 35 U.S.C. 154(b) by 488 days.

(21) Appl. No.: 11/588,381

(22) Filed: Oct. 27, 2006

(65) Prior Publication Data

US 2008/0098871 A1 May 1, 2008

(51) Int. Cl.
*A44B 11/00* (2006.01)
*G10G 5/00* (2006.01)

(52) U.S. Cl. ..... 24/658; 24/265 BC; 24/265 EC; 84/327; 224/257

(58) Field of Classification Search ..... 24/667, 24/668, 658, 649, 464, 265 R, 265 EC, 265 BC; 84/327; 224/257
See application file for complete search history.

(56) References Cited

U.S. PATENT DOCUMENTS

| | | | | |
|---|---|---|---|---|
| 681,699 | A | 9/1901 | Hewson | |
| 723,234 | A | 3/1903 | Bowker | |
| 927,323 | A | 7/1909 | Bryant | |
| 970,931 | A | 9/1910 | Kramer | |
| 1,133,615 | A | 3/1915 | Clark | |
| 1,169,542 | A * | 1/1916 | Isle | 24/658 |
| 1,187,994 | A * | 6/1916 | Ilse | 24/658 |
| 1,463,949 | A | 8/1923 | Gerber | |
| 1,754,200 | A | 4/1930 | Janes | |
| 2,039,110 | A | 4/1936 | Patchen | |
| 2,122,138 | A | 6/1938 | Hansen | |
| 2,221,821 | A | 11/1940 | Strehlein | |
| 2,226,262 | A | 12/1940 | Roberts | |
| 2,246,852 | A | 6/1941 | Kale | |
| 2,422,693 | A | 6/1947 | McArthur | |
| 2,966,356 | A | 12/1960 | Wilson et al. | |
| 3,037,416 | A | 6/1962 | Cunningham | |
| 3,102,446 | A | 9/1963 | Raleigh | |
| 3,306,483 | A | 2/1967 | Bellafiore | |
| 3,323,698 | A | 6/1967 | Sottile | |
| 3,583,042 | A | 6/1971 | Ishizaka | |
| 3,597,812 | A | 8/1971 | Allan | |
| 3,688,012 | A | 8/1972 | Vettel | |
| 3,826,024 | A * | 7/1974 | Petersen | 37/458 |
| D234,204 | S | 1/1975 | Miller et al. | |
| 4,028,981 | A | 6/1977 | Cravens | |
| D245,130 | S | 7/1977 | Perrin | |
| 4,046,296 | A | 9/1977 | McGhee | |
| 4,145,583 | A | 3/1979 | Oshgan et al. | |
| 4,188,851 | A | 2/1980 | Wolf | |

(Continued)

*Primary Examiner*—Robert J Sandy
(74) *Attorney, Agent, or Firm*—Wenderoth, Lind & Ponack, L.L.P.

(57) ABSTRACT

A connector for securing a guitar to a strap, having a body with an opening and an engagement member slidable within the body. The engagement member has an opening with two portions. The first portion is large enough to receive the anchor post and the second portion is narrow enough to prevent the anchor post from passing through it. The user slides the first portion into alignment with the opening in the body and inserts the anchor post. Then, the user slides the engagement member so that the second portion impedes the release of the anchor post. The body may also have an opening for removal of the engagement member and/or an opening to facilitate sliding of the engagement member. Also there is disclosed a flexible support with one or more connectors and a strap, and a system including connector(s), a strap and a guitar.

22 Claims, 4 Drawing Sheets

U.S. PATENT DOCUMENTS

| | | | | |
|---|---|---|---|---|
| 4,271,999 | A | 6/1981 | Stravitz | |
| 4,419,794 | A | 12/1983 | Horton, Jr. et al. | |
| 4,505,058 | A * | 3/1985 | Peterson | 403/13 |
| 4,653,422 | A | 3/1987 | Allen | |
| 4,698,882 | A | 10/1987 | Lang | |
| 4,993,127 | A | 2/1991 | Mechem et al. | |
| 5,054,170 | A | 10/1991 | Otrusina | |
| 5,177,837 | A | 1/1993 | Rekuc | |
| 5,850,996 | A | 12/1998 | Liang | |
| 5,868,293 | A | 2/1999 | D'Addario et al. | |
| 5,880,384 | A | 3/1999 | Beck | |
| 6,305,535 | B1 | 10/2001 | Fair | |
| 6,457,620 | B1 | 10/2002 | Batten et al. | |
| 6,590,145 | B2 | 7/2003 | Doiron | |
| 6,955,512 | B2 * | 10/2005 | Allen et al. | 411/353 |
| 2005/0284282 | A1 * | 12/2005 | D'Addario et al. | 84/327 |

* cited by examiner

GUITAR STRAP CONNECTOR

BACKGROUND OF THE INVENTION

This invention relates generally to connectors for securing straps to strap-supported devices, more particularly, this invention relates to connectors for securing straps to guitars or other devices.

Guitar strap connectors often consist of a keyhole shaped opening punched into the end of a strap. The hole is forced over a standard guitar strap button and relies on the stiffness of the strap connector material to keep the strap from accidentally slipping off the button. Under heavy or repeated use, the stiffness of the strap connector material may lessen and the strap connector may fail, resulting in possible damage to the instrument. Other guitar strap connectors have ameliorated this problem by reinforcing the keyhole shaped opening, but these guitar strap connectors can still fail when the guitar button accidentally slides into the wider section of the keyhole opening. Further, still other guitar strap connectors prevent this accidental engagement of the guitar by physically blocking off the wider part of the keyhole section after the connector is engaged to the anchor post. However, since there is more than one style of anchor post, users are then forced to purchase a separate connector for each style of anchor post. Further, some of these blocking mechanisms are bulky and unattractive.

There remains a need for a way to keep a guitar strap securely connected to a guitar that is attractive, durable, secure and can be easily attached or removed from the guitar. Further, there remains a need for a guitar strap that can be easily adapted for use with guitars having differently dimensioned anchor posts.

SUMMARY OF THE INVENTION

Described briefly, according to a typical embodiment of the present invention, a generally planar body is provided with an opening for mounting an anchor post, an internal space for a slidable engagement member and, optionally, an opening for convenient operation of the slidable engagement member and an opening for removing the slidable engagement member. The slidable engagement member can be a generally keyhole shaped high tensile strength wire loop defining an opening having a first portion and a second portion. The first portion is large enough to receive an anchor post and the second portion is sized to frictionally engage the sides of a lower portion of the anchor post. A user aligns the first portion of the opening with the opening in the body for mounting an anchor post, inserts the anchor post and then slides the loop so that the second portion of the opening is engaged with the anchor post. In this position, the anchor post is impeded from disengagement with the body by the wire loop.

The connector is useful as part of a flexible support system for a guitar wherein the connector is attached to a strap and the anchor post is attached to the guitar. The flexible support system of the present invention is less likely to fail than conventional flexible support systems as the engagement member does not lose stiffness with repeated use. Furthermore, a user of more than one member having an anchor post does not need to have a separate flexible support system for each member since, with the present invention, a user may simply replace the engagement member in the housing with an engagement member compatible with the desired anchor post. Finally, the connector of the present invention is capable of creating a tight, secure fit with the anchor post, thereby preventing accidental disengagement of the member having an anchor post.

DETAILED DESCRIPTION OF THE PREFERRED EMBODIMENTS

Figure 1:
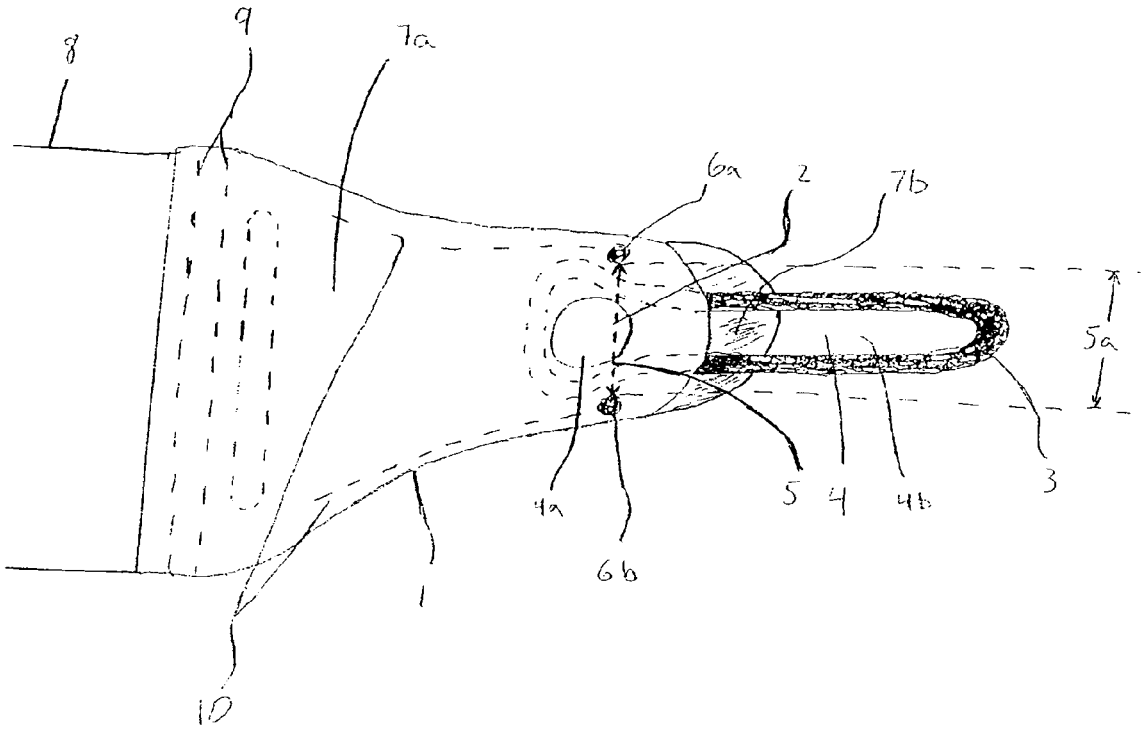
FIG. 1 is a top elevational view of a connector stitched to a strap with an engagement member aligned in a first position.
Figure 4:
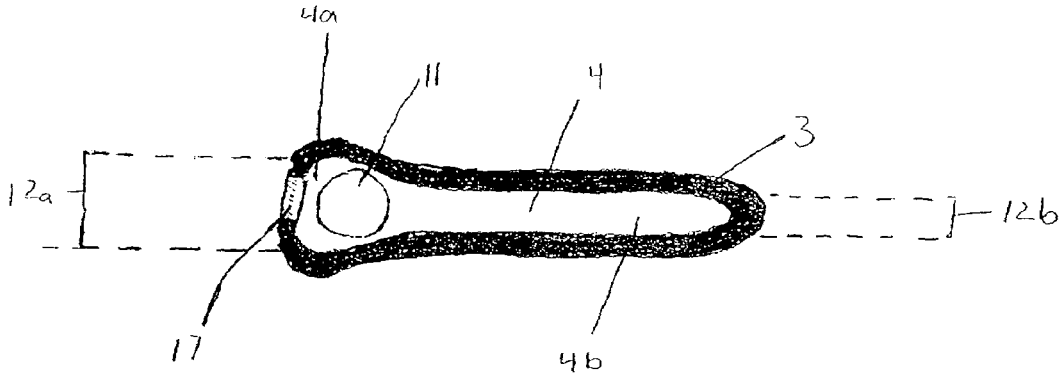
FIG. 4 is a top elevational view showing the engagement member having the anchor post inserted in a first portion of an opening of the engagement member.

FIG. 1 shows a connector for engaging an anchor post of a member according to a preferred embodiment. The connector comprises a body 1 having a first opening 2, and an engagement member 3 having a second opening 4 with a first portion 4*a* and a second portion 4*b*. As shown in FIG. 4, the first portion 4*a* has a dimension 12*a* greater than a dimension 12*b* of the second portion 4*b*, and the engagement member 3 is slidable within the body 1 between (i) a first position at which the first portion 4*a* of the second opening 4 is aligned with the first opening 2 to receive the anchor post when inserted into the body 1 through the first opening 2, and (ii) a second position at which the second portion 4*b* of the second opening 4 is aligned with the first opening 2 to prevent the anchor post from being removed from the body 1 through the first opening 2.

Figure 2:
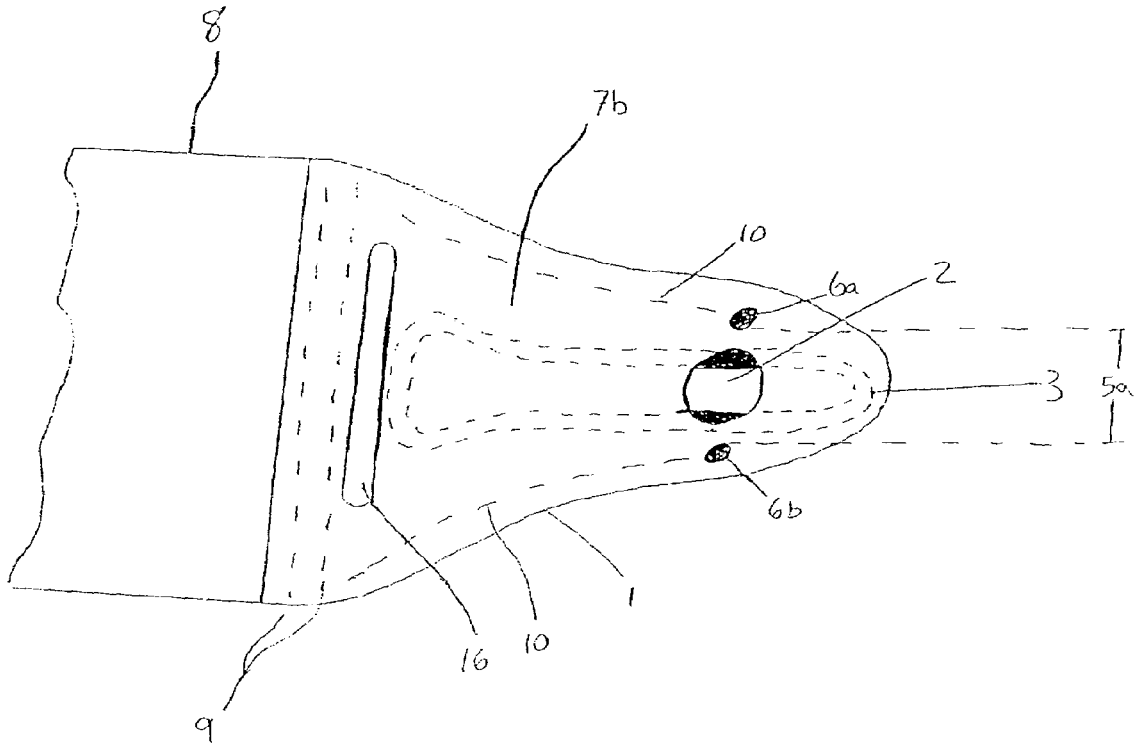
FIG. 2 is a bottom elevational view of the connector stitched to the strap with the engagement member aligned in a second position.

The body may be any suitable material or combination of materials such as fabric, metal, leather, natural materials or plastic. The body is more preferably made of natural or artificial fabric. The body is most preferably made of leather or a durable synthetic fabric such as nylon. The body may comprise one or more pieces of material. The body may comprise a single piece with a space within the body for the slidable engagement member. More preferably, the body is comprised of two flaps sewn, riveted, glued or otherwise joined together. The preferred embodiment shown in FIG. 1 and FIG. 2 shows the body 1 consisting of flaps 7*a* and 7*b* joined together by stitches 10. A space between non-joined portions of the flaps 7*a* and 7*b* defines an internal space within which the engagement member 3 is slidable between the first and second positions.

As shown in FIG. 1, an opening 5 (hereinafter fourth opening) is created between the two flaps along an outer perimeter where the two flaps are not joined. It is preferable that at two points where the two flaps are not joined to form the fourth opening, reinforcements such as rivets 6*a* and 6*b* or extra sewing are present to reinforce this opening and prevent failure of the fourth opening. Furthermore, as shown in FIG. 1, fourth opening 5 has a width 5*a*, defined by rivets 6*a* and 6*b*, which is less than the width of the engagement member around portion 4*a*. This feature prevents the engagement member from accidentally falling out of body 1 and becoming lost during a musical performance or in other situations where the connector is repeatedly removed from and then replaced on a member having an anchor post.

In an alternative arrangement of the body, two flaps are completely joined and the fourth opening is located in one of the flaps. Alternatively, there can be no fourth opening and the user slides the engagement member by manipulating the engagement member through the body or by a suitable mechanical device.

Figure 5:
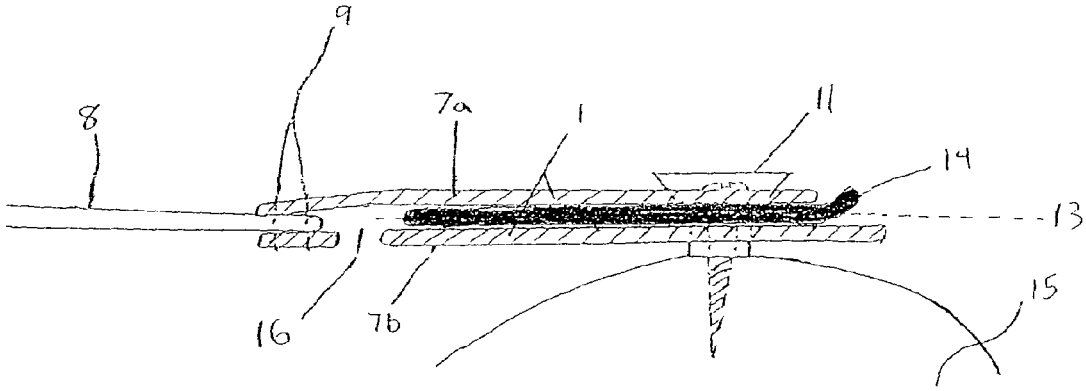
FIG. 5 is a longitudinal section through the connector stitched to the strap with the engagement member in the second position and secured to the anchor post.

In the preferred embodiment shown in FIG. 1, FIG. 2 and FIG. 5, the body is composed of two flaps 7*a* and 7*b* having different lengths, such that when the connector is engaged with an anchor post, the flap 7*b* is positioned between engagement member 3 and the member having the anchor post and protects the member having the anchor post from damage by engagement member 3 when the engagement member is in the second position. Alternatively, the flaps can be of the same length. In the arrangement where the fourth opening is located in one of the flaps, both flaps protect the member having the anchor post from damage by the engagement member. A body made of one, or more than two pieces, may also be configured in a similar manner with respect to the position of the engagement member to the member having an anchor post.

In the preferred embodiment, as shown in FIG. 1, strap 8 is attached to body 1 with stitches 9. As shown in FIG. 5, strap 8 is attached by stitches 9 to body 1 between flaps 7*a* and 7*b*. This feature ensures a secure and durable attachment. Alternatively, the strap can be stitched to an outer surface of the body. The strap may be permanently attached to the body by any suitable manner such as stitching, gluing or riveting. The strap can be composed of the same piece or pieces of material as the body, such as leather, fabric or nylon. The strap and one of the flaps can be composed of a single piece of material, such as leather, or the strap and the body can be composed of a single piece of material such as leather. Alternatively, the strap can be attached to a fastener which is connected to the body. The fastener may be any suitable structure such as a loop, buckle, clip, grommet or snap. The strap may be permanently attached to the fastener or be removably attached thereto. The fastener can be a buckle and the strap can be removed from the buckle and replaced. The strap may be of any suitable material or combination of materials such as fabric, metal, leather, natural materials or plastic. More preferably, the strap is made of leather or fabric. Most preferably, the strap is made of nylon or leather.

As shown in FIG. 1 and FIG. 2, first opening 2 passes completely through flap 7*a* and 7*b* of body 1. Alternatively, the first opening can only partially pass through the body and connect with the internal space for the engagement member. The first opening can be any shape but must be sufficiently sized to allow insertion of the desired anchor post. As illustrated in FIG. 1 and FIG. 2, the anchor post is a standard guitar button known in the art and first opening 2 is a substantially circular hole with a diameter equal to, or slightly larger than, the diameter of the top portion of a standard guitar button. As shown in cross section in FIG. 3 and FIG. 5, anchor post 11 tightly fits inside opening 1 and does not substantially move when the user slides the engagement member between the first position, which is shown in FIG. 1, and the second position which is shown in FIG. 2. Alternatively, the first opening has a diameter smaller than the diameter of the top portion of the anchor post but the portion of the body around the first opening is made of stretchable material such that the anchor post can be inserted into the first opening by an appropriate application of pressure.

As shown in FIG. 1 and FIG. 2, a third opening 16 is provided that allows a user to remove engagement member 3 from body 1. Further, a user can slide engagement member 3 between the first and second positions by inserting a finger, thumb or a suitable object into third opening 16. Additionally, a user can remove the engagement member from the third opening and then replace the engagement member in a more suitable orientation. This maneuver is often necessary if a user is utilizing the connector with different guitars having different anchor post orientations. Further, as shown in FIG. 2, a user can remove the engagement member from third opening 16 and replace it with a different engagement member that is more suitable for use with a different anchor post. This feature is very advantageous for a user of guitars with different types of anchor posts. A user can then utilize the same connector body and simply change the engagement member, dependent upon the style of the anchor post.

FIG. 4 shows engagement member 3 according to the preferred embodiment. The engagement member may be any suitable material, or combination of materials, such as metal, natural materials or plastic. The engagement member is more preferably made of metal and most preferably made of high tensile strength wire. The engagement member may be any shape suitable to slide within the body, so long as the engagement member has an opening with a first portion and a second portion, with the first portion having a width greater than a width of the second portion. The engagement member may be square, rectangular or generally triangular. FIG. 4 shows the engagement member 3 as a wire having the tapered or keyhole shaped second opening with the first portion 4*a* and the second portion 4*b*. As shown in FIG. 5, the engagement member has a longitudinal axis 13 and an end portion 14 bent away from longitudinal axis 13 such that when the engagement member 3 is within body 1, end portion 14 is bent away from a member having anchor post 15. This bend in the engagement member impedes damage, such as scratching, to the member having the anchor post. Alternatively, the engagement member does not have a bend in the end portion.

FIG. 4 shows the engagement member 3 having the second opening 4. It is preferable that the second opening is completely surrounded by the material forming the engagement member to improve durability. FIG. 4 shows engagement member 3 made of a wire loop that is attached at section 17 by brazing. Any suitable manner of attaching together a wire or other object or material to form the second opening may be used, such as welding, gluing, soldering or crimping. The engagement member may define an opening that is not completely closed. Alternatively, the first portion of the second opening farthest from the second portion is open. Alternatively, the second portion of the second opening farthest from the first portion is open.

Any suitable second opening shape may be used. Preferably, the shape of the second opening can be generally oval, elliptical, quadrilateral, triangular, irregular or v-shaped as long as the opening has a first portion and a second portion, with the first portion having a width greater than a width of the second portion. More preferably the second opening has a tapered width from the first portion to the second portion. Most preferably, the second opening has a keyhole shape with a width at the first portion that quickly narrows to a lesser width at the second portion.

FIG. 1 and FIG. 2 show part of a flexible support of the invention comprising the connector and strap 8 according to the preferred embodiment. The flexible support may be any suitable combination such as one connector and strap; two connectors and one strap; a connector, a strap, and a fastener for connecting the strap to the connector; or two connectors, a strap, and two fasteners for connecting the connectors to the strap. Furthermore, the flexible support can comprise two or more engagement members, in addition to straps, connectors and/or fasteners, so that a user may utilize the same strap or connector with a plurality of members having anchor posts, wherein the anchor posts have different dimensions. The strap, fastener and connector may be any of the embodiments described above.

A system including the connector of the preferred embodiment comprises a member having an anchor post, and a strap having attached thereto the connector. The system may be any suitable combination such as: a member having an anchor post, a strap and the connector; a member having an anchor post, a strap, the connector, and a fastener for connecting the strap to the connector; a member with more than one anchor post, a strap, and two or more connectors; a member with more than one anchor post, a strap, two or more connectors and two or more fasteners for connecting the connectors to the strap; or a plurality of members having one or more anchor posts, straps and/or connectors. Furthermore, the system can comprise two or more engagement members, in addition to straps, connectors, and members having anchor posts and/or fasteners, so that a user may utilize the same strap or connector with a plurality of members having anchors posts, wherein the anchor posts have different dimensions. The strap, fastener and connector may be any of the embodiments described above.

Figure 3:
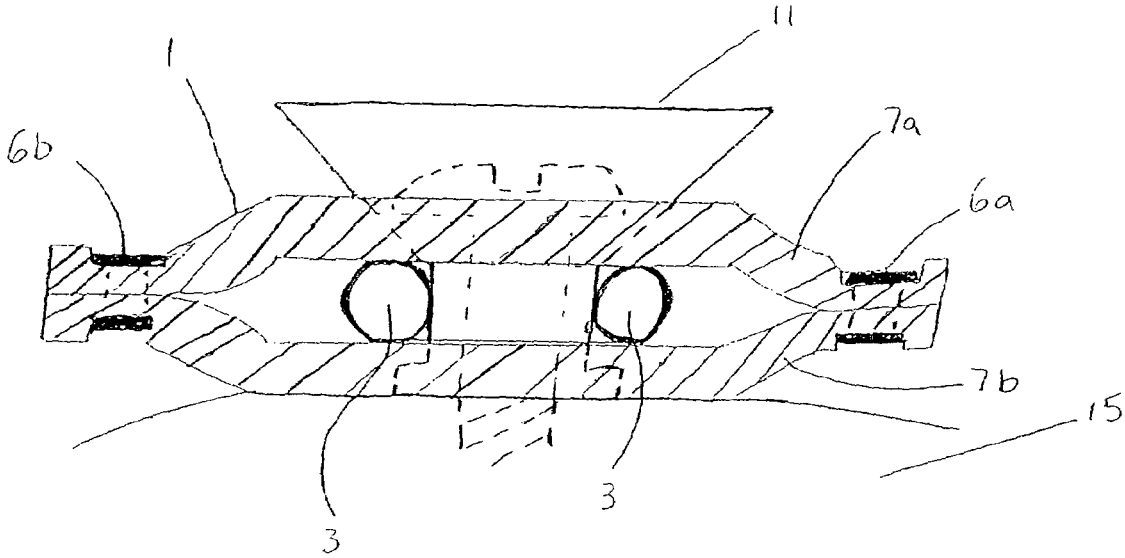
FIG. 3 is a cross sectional view showing the connector aligned in the second position and engaged with an anchor post.

Anchor posts include any suitable structure attached to a member such as a nail, screw, protrusion, peg or button. The anchor post may be made of any suitable material such as wood, metal or plastic. More preferably the anchor post is a peg or guitar button. The peg or guitar button may be any suitable shape including cylindrical, square, triangular or irregular. More preferably, the peg or guitar button is cylindrical. Most preferably the peg or guitar button has a top portion and a bottom portion, wherein the bottom portion is located between the top portion and a remainder of the member, with the bottom portion having a dimension smaller than a dimension of the top portion. FIG. 3 and FIG. 5 illustrate a typical guitar anchor post 11.

The system can also include any member having an anchor post, such as luggage, portable electronics, portable equipment, or musical instruments. More preferably, the member is a musical instrument. Still more preferably the member is a stringed instrument. Most preferably, the member is a guitar.

Though the connector is shown connected to a strap, it can be used absent any strap. Thus, while a preferred embodiment of the inventors has been illustrated and described, it will be obvious to those skilled in the art that various changes and modifications may be made therein without departing from the scope of this inventor as defined in the appended claims.

The invention claimed is:

1. A connector for engaging an anchor post of a member, comprising:

a body comprising natural or artificial fabric or leather having a first opening; and an engagement member having a second opening with a first portion and a second portion, said first portion having a dimension greater than a dimension of said second portion, wherein said engagement member is slidable within said body between (i) a first position at which said first portion of said second opening is aligned with said first opening to receive the anchor post when inserted into said body through said first opening, and (ii) a second position at which said second portion of said second opening is aligned with said first opening to prevent the anchor post from being removed from said body through said first opening and wherein the body has a forth opening to facilitate sliding of said embodiment member by a user, with a width less than a width of the first portion and greater than a width of the second portion, said width preventing said engagement member from accidentally falling out of said body.

2. The connector of claim 1, wherein said first opening is a substantially circular hole passing completely through said first body.

3. The connector of claim 1, wherein said second opening has a tapered width from said first portion to said second portion.

4. The connector of claim 1, wherein said body further has a third opening sized to removably receive said engagement member such that a user can conveniently exchange engagement members in said body.

5. The connector of claim 1, wherein said body further has a top portion and a bottom portion, and said engagement member has a longitudinal axis and an end portion bent away from said longitudinal axis and away from said bottom portion when said engagement member is within said body.

6. The connector of claim 1, wherein said body comprises leather.

7. A flexible support comprising:

a strap and a connector, attached to said strap, for engaging an anchor post of a member, said connector comprising:

(i) a body comprising natural or artificial fabric or leather having a first opening; and (ii) an engagement member having a second opening with a first portion and a second portion, said first portion having a dimension greater than a dimension of said second portion, wherein said engagement member is slidable within said body between (a) a first position at which said first portion of said second opening is aligned with said first opening to receive the anchor post when inserted into said body through said first opening, and (b) a second position at which said second portion of said second opening is aligned with said first opening to prevent the anchor post from being removed from said body through said first opening and wherein the body has a forth opening to facilitate sliding of said embodiment member by a user, with a width less than a width of the first portion and greater than a width of the second portion, said width preventing said engagement member from accidentally falling out of said body.

8. The flexible support of claim 7, wherein said first opening is a substantially circular hole passing completely through said first body.

9. The flexible support of claim 7, wherein said second opening has a tapered width from said first portion to said second portion.

10. The flexible support of claim 7, wherein said body further has a third opening sized to removably receive said engagement member such that a user can conveniently exchange engagement members in said body.

11. The flexible support of claim 7, wherein said body further has a top portion and a bottom portion, and said engagement member has a longitudinal axis and an end portion bent away from said longitudinal axis and away from said bottom portion when said engagement member is within said body.

12. The strap of claim 7, wherein said body comprises leather.

13. A system comprising:

a member comprising natural or artificial fabric or leather having an anchor post; and a strap having attached thereto a connector for engaging said anchor post of said member, said connector comprising:

(i) a body having a first opening; and (ii) an engagement member having a second opening with a first portion and a second portion, said first portion having a dimension greater than a dimension of said second portion, wherein said engagement member is slidable within said body between (a) a first position at which said first portion of said second opening is aligned with said first opening to receive the anchor post when inserted into said body through said first opening, and (b) a second position at which said second portion of said second opening is aligned with said first opening to prevent the anchor post from being removed from said body through said first opening and wherein the body has a forth opening to facilitate sliding of said embodiment member by a user, with a width less than a width of the first portion and greater than a width of the second portion, said width preventing said engagement member from accidentally falling out of said body.

14. The system of claim 13, wherein said anchor post has a fifth portion and a sixth portion, and wherein said fifth portion is located between said sixth portion and a remainder of said member with said sixth portion having a dimension greater than a dimension of said fifth portion and not greater than said dimension of said first portion, and with said dimension of said fifth portion being not less than said dimension of said second portion.

15. The system of claim 13, wherein said first opening is a substantially circular hole passing completely through said first body.

16. The system of claim 13, wherein said second opening has a tapered width from said first portion to said second portion.

17. The system of claim 13, wherein said body further has a third opening sized to removably receive said engagement member such that a user can conveniently exchange engagement members in said body.

18. The system of claim 13, wherein said body further has a top portion and a bottom portion, and said engagement member has a longitudinal axis and an end portion bent away from said longitudinal axis and away from said bottom portion when said engagement member is within said body.

19. The system of claim 13, wherein said body comprises leather.

20. The system of claim 14, wherein said dimension of said second portion is sized to frictionally engage said fifth portion of the anchor post at said second position.

21. The system of claim 13, wherein said member is a musical instrument.

22. The system of claim 21, wherein said musical instrument is a guitar.

* * * * *